US005164024A

United States Patent [19]

Nishimoto et al.

[11] Patent Number: 5,164,024

[45] Date of Patent: Nov. 17, 1992

[54] METHOD OF MAKING NON-ORIENTED ELECTRICAL STEEL SHEETS HAVING EXCELLENT MAGNETIC PROPERTIES

[75] Inventors: Akihiko Nishimoto; Yoshihiro Hosoya; Kunikazu Tomita; Toshiaki Urabe; Masaharu Jitsukawa, all of Tokyo, Japan

[73] Assignee: NKK Corporation, Tokyo, Japan

[21] Appl. No.: 476,507

[22] PCT Filed: Apr. 26, 1989

[86] PCT No.: PCT/JP89/00439

§ 371 Date: Jun. 13, 1990

§ 102(e) Date: Jun. 13, 1990

[87] PCT Pub. No.: WO90/12896

PCT Pub. Date: Nov. 1, 1990

[51] Int. Cl.[5] ..... H01F 1/04

[52] U.S. Cl. ..... 148/111; 148/112

[58] Field of Search ..... 148/111, 112

[56] References Cited

FOREIGN PATENT DOCUMENTS 58-151453 9/1983 Japan .

58-171527 10/1983 Japan .

*Primary Examiner*—John P. Sheehan

*Attorney, Agent, or Firm*—Nields & Lemack

[57] ABSTRACT

A method of producing non-oriented electrical steel sheets having excellent magnetic properties which comprehends heating a steel at the low temperature for hot rolling, thereby to minimize re-solution of AlN particles when a slab is cooled, so that coarsening of AlN particles is facilitated during annealing the hot rolled sheet; and coiling at low temperatures for controlling the amount of scale generation. De-scaling is perfectly accomplished after the hot rolling, and the hot rolled sheet is annealed in a non-annealing atmosphere, thereby to control the oxidation and the nitriding to a minimum during annealing the hot rolled sheet, and the annealing conditions of the hot rolled sheet are specified for proper coarsening of the cohesion, taking into consideration the magnetic properties and the economics.

2 Claims, 3 Drawing Sheets

Slab heating temperature : 1120 °C
Final annealing conditions : 950 °C x 2min
25% $H_2$ + 75% $N_2$
Dew point : -10 °C

METHOD OF MAKING NON-ORIENTED ELECTRICAL STEEL SHEETS HAVING EXCELLENT MAGNETIC PROPERTIES

TECHNICAL FIELD

This invention relates to a method of making non-oriented electrical steel sheets having excellent magnetic properties.

BACKGROUND OF THE INVENTION

If a steel blankwork containing more than 1% Si is hot rolled, generally the hot rolled sheet is recrystallized at the surface layer only, and the middle layer is composed of a rolled and non-recrystallized structure. If such a hot rolled sheet is cold rolled and annealed as it is, magnetic properties can not be provided, since a texture beneficial to the magnetic properties develops insufficiently. For securing the magnetic properties after the cold rolling and annealing, the hot rolled structure should be perfectly recrystallized. For example, Japanese Patent Application Laid Open Specifications No.68717/79 or No.97426/80, aiming at such objects, disclose annealings on the hot rolled sheet by a batch annealing or a continuous annealing after hot rolling and coiling.

In the annealing of the hot rolled sheet as such, if the recrystallization treatment is carried out on the hot rolled sheet, and if the annealing is done in an insufficient non-oxidizing atmosphere, the scales remaining on the surface thereof develop and grow thick, and internal oxidized layers grow in the steel surface layer so that a pickling ability after the treatment is markedly deteriorated. On the other hand, in spite of the non-oxidizing atmosphere, if the annealing is done in the atmosphere containing nitrogen, a nitriding reaction is accelerated in the steel surface layer, and it combines with Al in the steel and brings about precipitations of AlN in the steel surface layer. Therefore, AlN particles considerably lower ferrite grain growth in a final annealing. As a result, the steel surface layer is formed with regions of fine ferrite grains of about 20 μm in thickness of about 100 μm, which remarkably deteriorate properties of iron losses and magnetic properties at low magnetic fields.

In view of these circumstances, Japanese Patent Application Laid Open Specification No.35627/82 discloses an art of performing the pickling after the coiling at high temperature and subsequently a batch annealing. However, at coiling temperatures of higher than 700° C., not only does the scale on the surface grow thick, but also an oxidation is caused in the ferrite grains, if the steel sheet contains more than 1 wt % Si. The oxidized layer in the ferrite grain cannot be perfectly removed by the pickling before the annealing of the hot rolled sheet, and the magnetic properties are deteriorated as state above.

Further, in the annealing of the hot rolled sheet, it is necessary to perfectly precipitate AlN for satisfied ferrite grain growth at a final annealing, and coarsen the precipitated AlN, for which a sufficient soaking time should be carried out in the annealing. If the soaking time is short and the coarsening of AlN particles is insufficient, the grain growth at the final annealing is spoiled by the inhibiting effect of movements of the grain boundaries due to AlN particles.

DISCLOSURE OF THE INVENTION

Taking these problems into consideration, it is an object of the invention to provide a method of making non-oriented electrical steel sheets having excellent magnetic properties.

For accomplishing this object, the invention passes the steel of specific chemical composition through the following steps so as to cause the ferrite grains to grow satisfactorily in the final annealing for providing the non-oriented electrical steel sheets having excellent magnetic properties.

1) The steel material is heated at the low temperature for hot rolling, thereby to reduce as much as possible re-solution of AlN particles when a slab is cooled, so that the coarsening of AlN particles is facilitated during the annealing of the hot rolled sheet.

2) The coiling is carried out at the low temperature for checking the amount of scale generation, and a de-scaling is perfectly done after the hot rolling. The de-scaled hot rolled sheet is annealed in the non-oxidizing atmosphere, thereby to control the oxidation and the nitriding to a minimum during annealing of the hot rolled sheet.

3) The annealing conditions of the hot rolled sheet are specified for proper coarsening of AlN particles, taking into consideration the magnetic properties and the economics.

That is, the invention is basically characterized by heating a slab containing C: not more than 0.0050 wt %, Si: 1.0 to 4.0 wt % Al: 0.1 to 2.0 wt %, the rest being Fe and unavoidable impurities to temperature between higher than 1050° C. and less than 1150° C.; hot rolling; coiling at temperatures of not higher 700° C.; de-scaling; subsequently annealing the hot rolled sheet at a relation between temperature of 750° to 1050° C. and the soaking time t (min.), in a non-oxidizing atmosphere and under conditions satisfying $$-131.3 \log t + 1012.6 \leqq T \leqq -128.5 \log t + 1078.5;$$

carrying out one cold-rolling or two or more cold rollings having an intermediate annealing interposed therebetween, and final-annealing at temperatures between 800° and 1050° C.

DETAILED DESCRIPTION OF THE INVENTION

Steel making conditions of the invention will be explained together with limiting reasons therefor.

A slab to be hot rolled is composed of C: not more than 0.0050 wt %, Si: 1.0 to 4.0 wt %, Al: 0.1 to 2.0 wt % the rest being Fe and unavoidable impurities.

If the carbon content exceeds 0.0050 wt %, the magnetic properties are deteriorated, and problems arise regarding magnetic aging. Therefore the upper limit is determined to be 0.0050 wt %.

If the silicon content is less than 1.0 wt %, the values of low iron loss cannot be satisfied by lowering a specific resistance. If the content is more than 4.0 wt %, a cold workability is considerably worsened. Thus, The Si content is determined to be 1.0 to 4.0 wt %.

If the aluminum content is less than 0.1 wt %, fine precipitation of AlN is caused, and the grain growth suitable to the final annealing can not be obtained so that the magnetic properties are deteriorated. If the Al content is more than 2.0 wt %, the cold workability is decreased. Thus, the Al content is 0.1 to 2.0 wt %.

For hot rolling the slab of the above mentioned composition, it is then heated to the low temperature of higher than 1050° C. but less than 1150° C., in order to minimize the re-solution of AlN particles precipitated during cooling after casting.

Since the crystallization of the hot rolled sheet during annealing thereon is accomplished earlier than coarsening of AlN particles, the latter is the greatest target in the annealing of the hot rolled sheet. The time necessary to accomplish said coarsening is varied in dependence upon the heating temperatures of the slab. The more the re-solving amount, during heating of the slab, of coarse AlN particles precipitated during cooling after solidifying the cast slab, the longer the time for coarsening AlN particles during annealing the hot rolled sheet. Thus in the invention, the slab is heated to the low temperature, thereby to ensure the re-solution amount of the coarse AlN particles is a minimum, so that it is possible to anneal the hot rolled sheet for a short period of time.

If the heating temperature of the slab is higher than 1150° C., the resolution amount of AlN particles increases and said coarsening during annealing is delayed, and consequently a long time should be taken for soaking in the annealing. If it is less than 1050° C., the finish temperature is too low, and the mill load increases, and it is difficult to maintain the shape of the hot rolled sheet.

Figure 1:
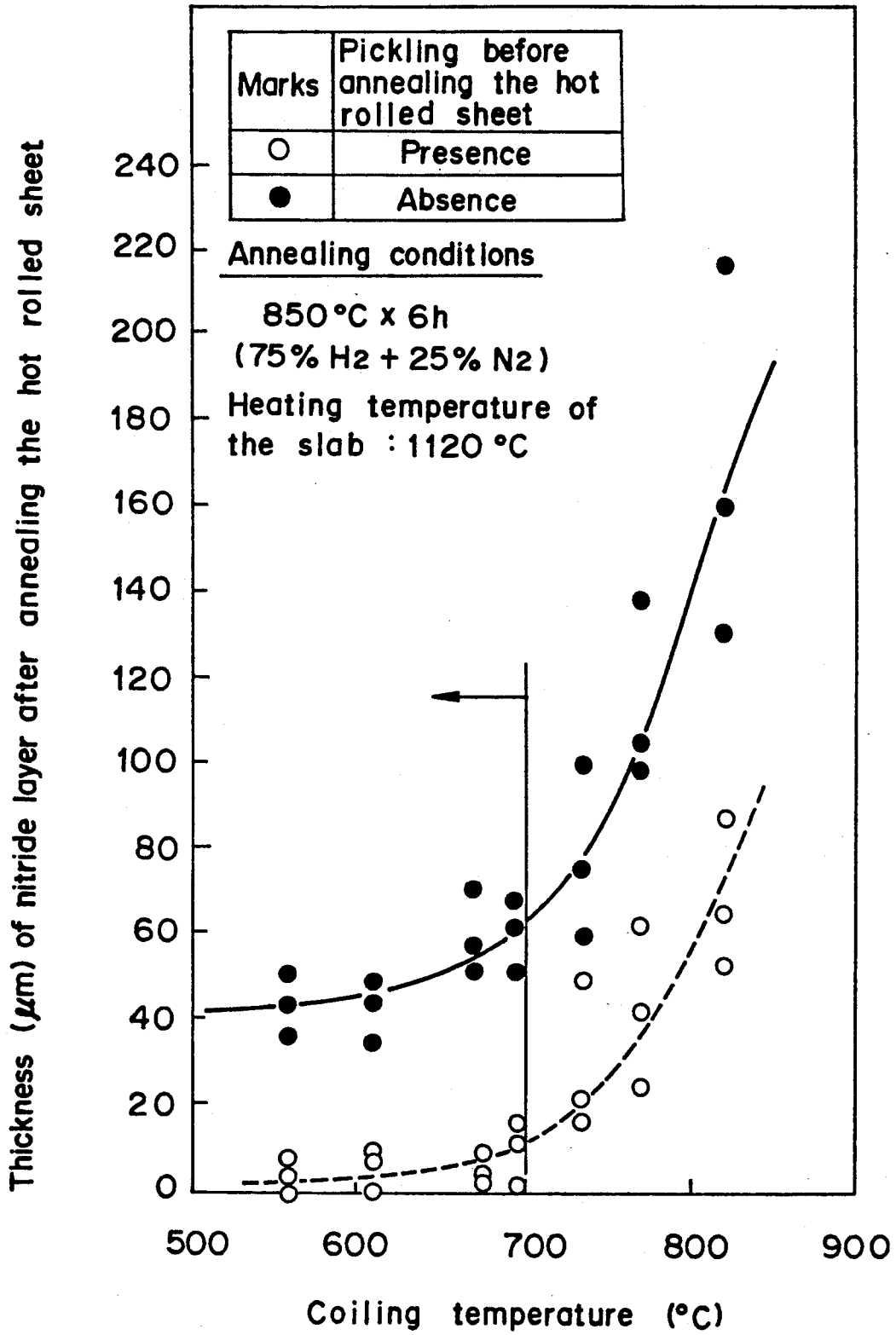
FIG. 1 shows influences of hot rolling and coiling temperatures on the thickness of the nitriding layer after annealing the hot rolled sheet.

One of the most important technologies of the invention is to coil the hot rolled sheet at the temperature of lower than 700° C. after hot rolling. If the coiling temperature is higher than 700° C., the scale grows thick on the surface of the hot rolled sheet. Even if descaling such as pickling is carried out before the annealing of the hot rolled sheet, the scale on the steel surface will be removed but it is difficult to remove the internal oxidized layer formed in high Si steel. As later mentioned, if the scale remains when annealing the hot rolled sheet, the nitriding reaction is accelerated due to the scale as a catalyzer so that the precipitated layer of AlN is formed under the surface layer of the steel sheet. As a result, the grain growth therein is checked at the final annealing to provoke an increase of the iron loss. FIG. 1 shows the relation between the coiling temperature and the thickness of the nitride layer after the annealing of the hot rolled sheet, and if the coiling temperature is higher than 700° C., it is seen that the nitriding reaction is largely accelerated by the remaining scales.

The other important feature of the invention is that the hot rolled sheet is performed with the de-scaling treatment before the subsequent annealing. If the annealing is carried out in the non-oxidizing atmosphere containing nitrogen as the scales remain on the surface, the nitriding reaction is accelerated in the steel surface layer to increase the nitrogen content. Therefore, the fine AlN particles considerably lower the grain growth of ferrite at the final annealing and form thick layers of fine ferrite grains in the steel surface so as to substantially deteriorate the iron loss and magnetic characteristics of the low magnetic field. Thus, the aim of the present invention is to suppress the nitriding reaction by removing the scales before annealing the hot rolled sheet.

The de-scaling is normally carried out by the pickling, but may depend on mechanical treatments, and no limit is made to actual method. In the invention, since the scale formation is suppressed by the low temperature coiling, it is possible to almost perfectly remove the scale by said de-scaling.

The hot rolled sheet is annealed after de-scaling in the non-oxidizing atmosphere under the condition satisfying $$-131.3 \log t + 1012.6 \leqq T \leqq -128.5 \log t + 1078.5$$

in the relation between the annealing temperature T (°C.) of 750° to 1050° C. and the soaking time t (min).

As stated above, with respect to the blankwork containing more than 1 wt % Si, the hot rolled sheet is recrystallized at parts of the surface only, and the middle layer is composed of the rolled and non-recrystallized structure. Therefore, if the hot rolled sheet is cold rolled and annealed as it is, the magnetic properties could not be provided securely. For improving the magnetic properties after the final annealing and keeping it uniform, it is necessary to provide recrystallization uniform in the thickness, width and length of the coil. There is a close relation between the value of the iron loss and the ferrite grain size after the final annealing, and when the ferrite grain size is around 100 to 150 μm, the value of the iron loss is the minimum. Thus, for satisfying the growth of the ferrite grain at the final annealing, AlN must be perfectly precipitated at annealing the hot rolled sheet, and they (or AlN particles) must be coarsened, since the inhibiting effect of the movement of the grain boundaries is decreased.

If the soaking temperature is less than 750° C., it requires soaking for more than 5 hours for perfectly recrystallizing the hot rolled sheet inefficiently. On the other hand, if the soaking temperature is higher than 1050° C., solubility of the steel sheet to AlN particles becomes high, so that the precipitation amount of AlN particles is insufficient and the growth of the ferrite particles is decreased at the final annealing.

Figure 2:
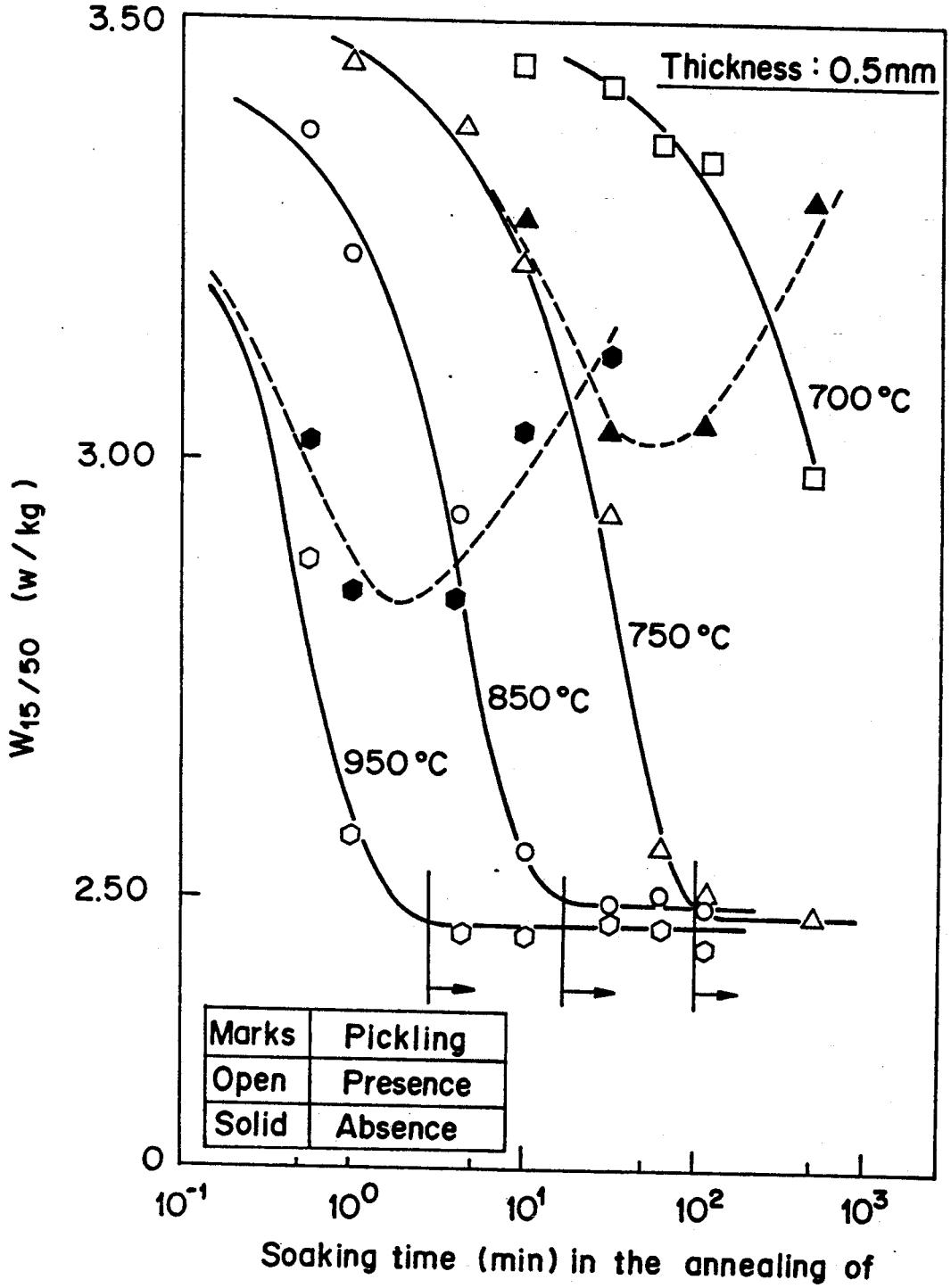
FIG. 2 shows influences of soaking temperature and soaking time in annealing the hot rolled sheet on the magnetic properties after the final annealing.
Figure 3:
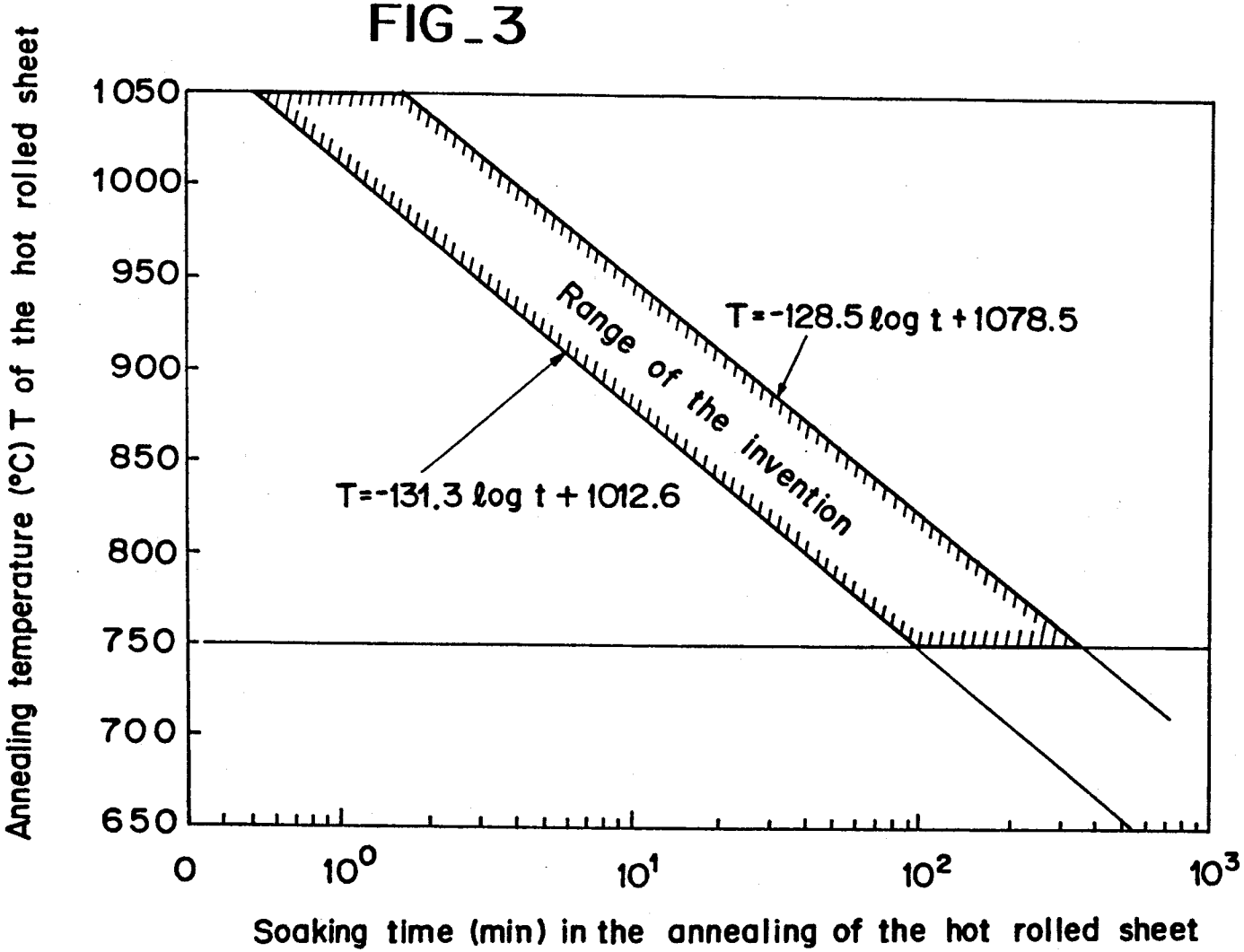
FIG. 3 shows annealing conditions of the hot rolled sheet in the invention.

FIG. 2 shows the influences of the soaking temperature and time at the annealing of the hot rolled sheet on the magnetic properties after the final annealing. FIG. 3 summarizes the soaking conditions in reference to the results of FIG. 2.

For decreasing the value of the iron loss, it is necessary to fully coarsen AlN particles by annealing the hot rolled sheet, and as shown in FIGS. 2 and 3, the soaking conditions therefor are determined by the relation between the soaking temperature T and time t. That is, for coarsening of AlN particles, in the hot rolled sheet heated at the low temperature - coiled at the low temperature, the condition of $$T \geqq -131.1 \log t + 1012.6$$

must be satisfied.

If the soaking is carried out until the under mentioned formula, the recrystallization of ferrite grains and the coarsening of the cohesion of AlN particles are accomplished, and a further soaking will be inefficient $T \leqq -128.5 \log t + 1078.5.$ The hot rolled sheet is annealed in the non-oxidizing atmosphere for avoiding the formation of the scales which encourage the nitriding. For example, it is desirable to perform the annealing in an atmosphere containing a mixture of nitrogen - hydrogen of more than 5% $H_2$.

The steel sheet annealed as above is, if required, subjected to the pickling, and to one cold rolling or two or more cold rollings having the intermediate annealing interposed therebetween, and subsequently to the final annealing at the temperature of 800° to 1050° C.

If the soaking temperature in the final annealing is less than 800° C., the iron loss and a magnetic flux density the invention aims at cannot be improved enough, but if it is higher than 1050° C., it is not practical in view of running of the coil and the cost of energy. Further, in the magnetic properties, the value of the iron loss increases by an abnormal growth of the ferrite grains.

EXAMPLE 1

The non-oriented electrical steel sheets were produced from the steel materials of the chemical compositions of Table 1 under following conditions. Table 2 shows the magnetic properties after the final annealings.

Making of molten steel
↓
Continuously casting
↓
Hot rolling (Heating Temp.: 1080° C., Coiling Temp.: 630° C. Finished thickness: 2.0 mm$^t$)
↓
Pickling
↓
Annealing of hot rolled sheet (850° C. × 30 min, 75% $H_2$ + 25% $N_2$)
↓
Pickling
↓
Cold rolling (0.5 mm$^t$)
↓

-continued

Annealing (950° C. × 2 min, 25% $H_2$ + 75% $N_2$, dew point: −10° C.)

TABLE 1

| Samples | C | Si | Mn | P | S | Sol.Al | N | — |
|---|---|---|---|---|---|---|---|---|
| | (wt %) | | | | | | | |
| A | 0.0026 | 3.04 | 0.17 | 0.005 | 0.003 | 0.02 | 0.0034 | Comparative Steel |
| B | 0.0028 | 3.06 | 0.18 | 0.005 | 0.003 | 0.53 | 0.0028 | Inventive Steel |
| C | 0.0029 | 1.73 | 0.17 | 0.004 | 0.003 | 0.31 | 0.0031 | " |
| D | 0.0026 | 1.71 | 0.17 | 0.005 | 0.003 | 0.03 | 0.0035 | Comparative Steel |

TABLE 2

| Samples | $W_{15/50}$ (W/Kg) | $B_{50}$ (T) |
|---|---|---|
| A | 3.37 | 1.654 |
| B | 2.48 | 1.682 |
| C | 3.65 | 1.715 |
| D | 4.21 | 1.703 |

Magnetic properties were measured by the 25 cm Epstein testing appartus

EXAMPLE 2

The non-oriented electrical steel sheets were produced from the steel material B of Table 1 under the following conditions and conditions of Table 3. Table 3 shows the heating temperatures of the produced steel sheets.

Molten Steel
↓
Continuously Casting
↓
Hot Rolling (Finished Thickness: 2.0 mm$^t$)
↓
Pickling
↓
Annealing of Hot Rolled Sheet
↓
Pickling
↓
Cold Rolling (0.5 mm$^t$)
↓
Annealing (950° C. × 2 min, 25% $H_2$ + 75% $N_2$, Dew point: −10° C.)

Conditions of Table 3

TABLE 3

| No. | — | Hot Rolling Heating Temperature | Hot Rolling Coiling Temperature | Pickling | Annealing of hot rolled sheets Soaking conditions | Annealing of hot rolled sheets Atmosphere | Magnetic properties $W_{15/50}$ | Magnetic properties $B_{50}$ |
|---|---|---|---|---|---|---|---|---|
| 1 | Comparative Example | 1250° C. | 630° C. | Yes | 850° C. × 30 min | 75% $H_2$ + 25% $N_2$ | 3.10 (W/Kg) | 1.667 (T) |
| 2 | Inventive Example | 1080° C. | 630° C. | " | " | " | 2.48 | 1.682 |
| 3 | Com. Ex | " | " | Non | " | " | 3.25 | 1.670 |
| 4 | " | " | 770° C. | Yes | " | " | 3.43 | 1.671 |
| 5 | " | " | " | Non | " | " | 3.51 | 1.663 |
| 6 | " | " | 630° C. | Yes | – | $N_2$ | 3.31 | 1.668 |
| 7 | " | " | " | " | 700° C. × 100 min | 75% $H_2$ + 25% $N_2$ | 3.09 | 1.631 |
| 8 | " | " | " | " | 800° C. × 10 min | " | 2.94 | 1.674 |
| 9 | Inv. Ex. | " | " | " | 950° C. × 3 min | 10% $H_2$ + $N_2$ | 2.46 | 1.680 |
| 10 | Com. Ex. | " | " | " | — | — | 3.36 | 1.627 |
| 11 | " | " | 820° C. | " | — | — | 3.32 | 1.663 |

Magnetic properties were measured by the 25 cm Epstein testing apparatus.

INDUSTRIAL APPLICABILITY

The present invention may be applied to a method of making non-oriented electrical steel sheet having excellent magnetic properties.

What is claimed is:

1. A method of making non-oriented electromagnetic steel sheets having excellent magnetic properties, comprising heating a slab containing C: not more than 0.0050 wt %, Si: 1.0 to 4.0 wt %, Al: 0.1 to 2.0 wt %, the rest being Fe and unavoidable impurities to a temperature range between not less than 1050° C. and less than 1150° C.; and hot rolling said slab, and thereafter coiling the hot-rolled sheet at temperatures of not more than 700° C. and de-scaling; subsequently in a non-oxidizing atmosphere annealing the hot rolled sheet at an annealing temperature (T) (°C.) which is in the range 750° to 1050° C. and under conditions in which the relation between the temperature T and the soaking time t (min.), satisfies the equation $$-131.3 \log t + 1012.6 \leqq T \leqq -128.5 \log T + 1078.5;$$

carrying out one cold-rolling or two or more cold rollings having interposed therebetween an intermediate annealing, and thereafter final-annealing at temperatures between 800° and 1050° C.

2. A method as claimed in claim 1, comprising carrying out the annealing of the hot rolled steel sheet in an atmosphere containing a mixture of nitrogen-hydrogen of more than 5% $H_2$.

* * * * *